United States Patent [19]

Brasier et al.

[11] Patent Number: 4,913,677

[45] Date of Patent: Apr. 3, 1990

[54] GUIDE STICK AND HOOP TOY

[76] Inventors: Donald W. Brasier, 2517 W. Brady, Tulsa, Okla. 74127; Larry Schwegman, 4806 S. Sheridan Rd., Tulsa, Okla. 74145

[21] Appl. No.: 312,758

[22] Filed: Feb. 21, 1989

[51] Int. Cl.[4] ..... A63H 33/02

[52] U.S. Cl. ..... 446/453; D21/101

[58] Field of Search ..... 446/450, 451, 452, 453; 273/126 R; D21/101

[56] References Cited

U.S. PATENT DOCUMENTS

| | | | |
|---|---|---|---|
| D. 170,677 | 10/1953 | Chrisco | 446/450 X |
| D. 214,675 | 7/1969 | Moore | 446/450 X |
| D. 223,844 | 6/1972 | Rath | D21/101 |
| D. 240,243 | 6/1976 | Frudeger | 446/450 X |
| D. 275,982 | 10/1984 | Heijligers | D21/101 X |
| 1,272,240 | 7/1918 | Enomoto | 446/450 |
| 2,381,581 | 8/1945 | Entringer | 446/450 |
| 3,003,766 | 10/1961 | Stanton | 446/450 X |
| 3,078,620 | 2/1963 | Frye, Jr. et al. | 446/450 |
| 3,123,937 | 3/1964 | Pace | 446/450 |
| 3,254,443 | 6/1966 | Olson | 446/450 |
| 3,788,000 | 1/1974 | Jenkins | 446/450 |
| 4,091,564 | 5/1978 | Jasinski | 446/450 |
| 4,102,077 | 7/1978 | Marino | 446/453 |
| 4,682,971 | 7/1987 | Washington | 446/450 |
| 4,799,917 | 1/1989 | Lentz | 446/450 |

*Primary Examiner*—Randolph A. Reese
*Assistant Examiner*—Jeffrey L. Thompson

[57] ABSTRACT

A toy hoop and guidestick inexpensive to fabricate giving increased control of the hoop is provided by an improved stick with a specially shaped yoke that permits changing movement of the hoop to the left or to the right by wrist motion only.

2 Claims, 3 Drawing Sheets

GUIDE STICK AND HOOP TOY

BACKGROUND OF THE INVENTION:

1. Field of the invention

This invention relates to the improvement of guide stick and hoop toys wherein greater ease of operation of the rolling hoop is achieved in modification of the known stick and hoop toys so that the hoop is easily controlled and made to move in any direction except upward, i.e. to the right, or to the left, forward and down. The design of the hoop and guide stick is especially suited to mass production, and is adaptable to a wide variety of materials with thermoplastic materials being the optimal materials for fabrication of the hoop and guide stick.

2. Description of the Prior Art

The prior art involving a hoop and a stick is well described by U.S. Pat. No. 4,682,971 issued July 28, 1987, which is herein quoted directly:

"Around the turn of the century, a popular game played by children included a hoop and a stick.

The hoop would be made to roll in a vertical plane by a child who would run along with the rolling hoop and hit it with a stick from time to time to keep it rolling and to otherwise direct its movement."

Over the years various improvements on the basic stick and hoop toy have evolved which are exemplified by U.S. Pat. No. 4,682,971 above cited, U.S. Pat. No. 3,078,620 issued Feb. 28, 1963 to Frye et al, U.S. Pat. No. 3,254,443 issued June 7, 1966 to Olson and U.S. Pat. No. 4,091,564 issued May 30, 1978 to Jasinski. All of these patents involve improved means of control over the hoop via modification of the end of the stick to increase control over the rolling hoop which modifications are evident from drawings of each of these patents.

SUMMARY OF THE INVENTION

Figure 1:
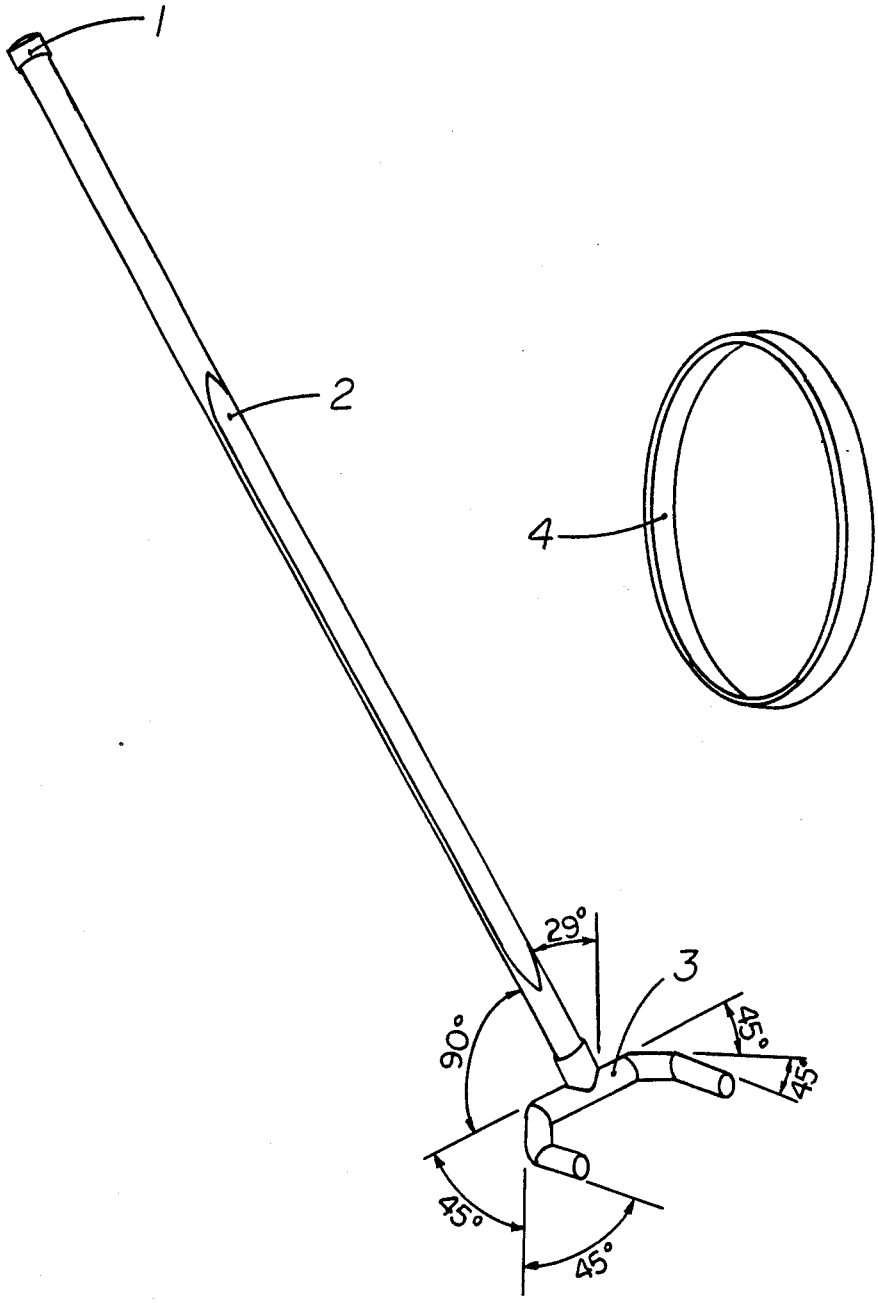
Figure 2:
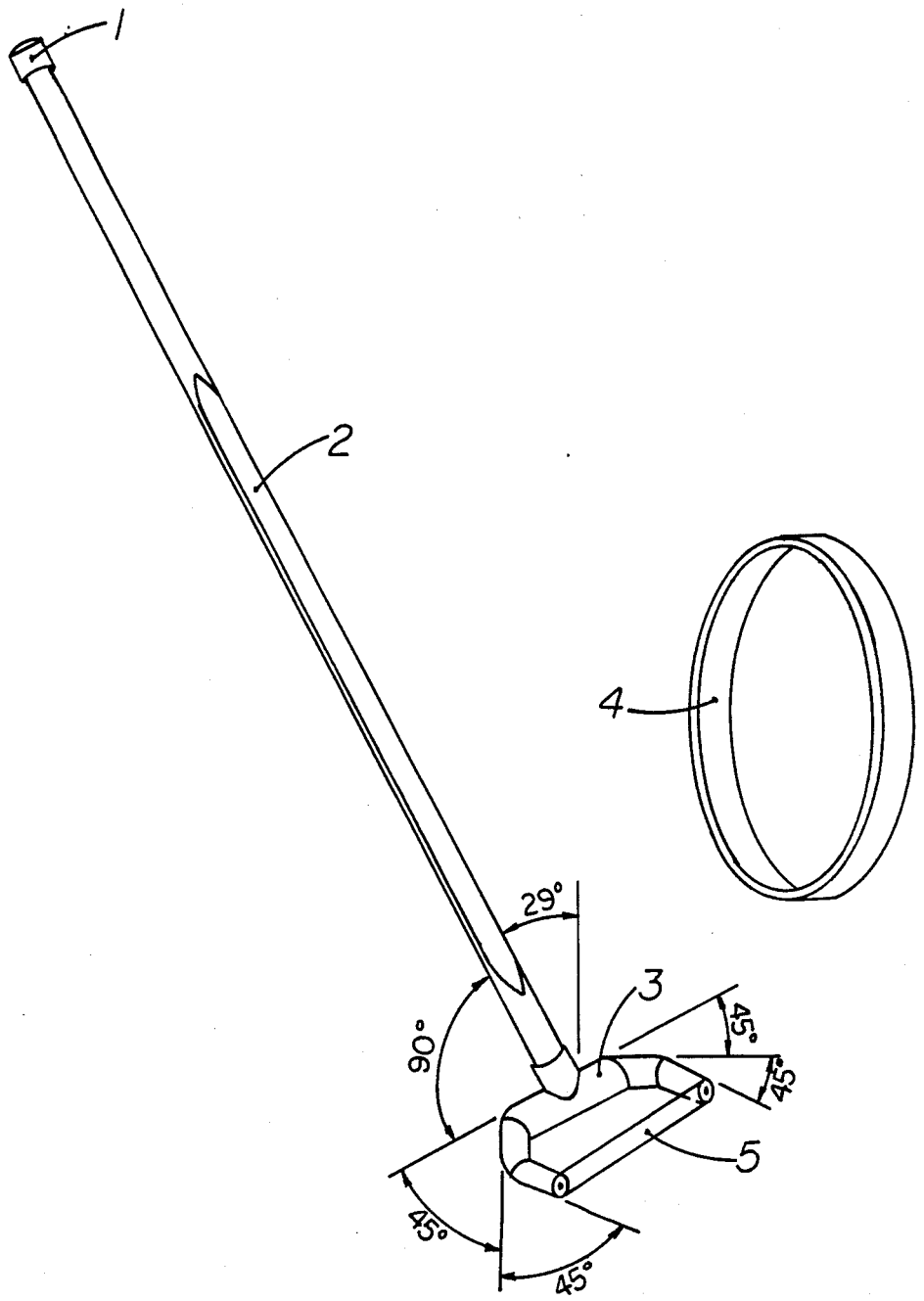

The present invention provides an improved guide stick for the hoop that is inexpensive to fabricate and which gives greater ease of control over the direction of the rolling hoop. The guide stick may take several forms as illustrated by FIGS. 1 and 2. FIG. 1 shows the basic construction of the guide stick comprised of a handle and attached yoke as used by non-beginners. FIG. 1 shows the cap 1 on the rounded handle which preferably has a depression 2 for starting the hoop by placing the hoop at the top of the depression and letting it roll down the depression and onto the ground. This depression can be omitted in which case the hoop is placed on the ground and started by pushing it. The end of the handle is attached to the yoke at an angle of 29 degrees from vertical forming a 90 degree angle at its connection with the yoke. The yoke consists of a T section 3 with two 45 degree extension sections attached to both ends of the T as shown in FIGS. 1 and 2. FIG. 1 shows the hoop 4 which can vary in size, but is preferably about a foot in diameter, and about 1½ inches wide. This hoop can be cut from 12 inch PVC tubing, or manufactured by direct molding means.

The guide stick can be fabricated by joining conventional PVC components such as PVC tubing (½ to 1 inch types), a PVC cap, T sections 45 degree bends and end pieces. The yoke may alternatively be manufactured in one piece in the shape shown in molds or by injection molding of various suitable plastics, such as PVC plastic, polyethylene plastic or polycarbonate plastic. The stick may be hollow or solid as is the case with the yoke 3, although hollow construction is preferred for less weight and material waste.

FIG. 2 shows the guide stick as modified for beginners who have not yet acquired skill in manipulation of the rolling hoop. FIG. 2 is the same as FIG. 1 except that the yoke 3 is modified to accept the strip 5 shown in the shaded area which keeps the hoop enclosed within the yoke. This strip can be plastic or metal and may be fastened by screws or bolts and the threads may be molded into the yoke itself if molded, or by inserts into hollow PVC tubing. FIG. 2 shows the hoop 4 which is the same as that of FIG. 1 already described supra.

The length of the handle will vary according to the size of the child and ordinarily is about 31 to 36 inches long. When constructed of PVC plastic, it is about ½ inch to 1 inch in diameter. The width of the yoke 3 is about 6 inches with about 4 inches in the opening at the end of the yoke.

Figure 3:
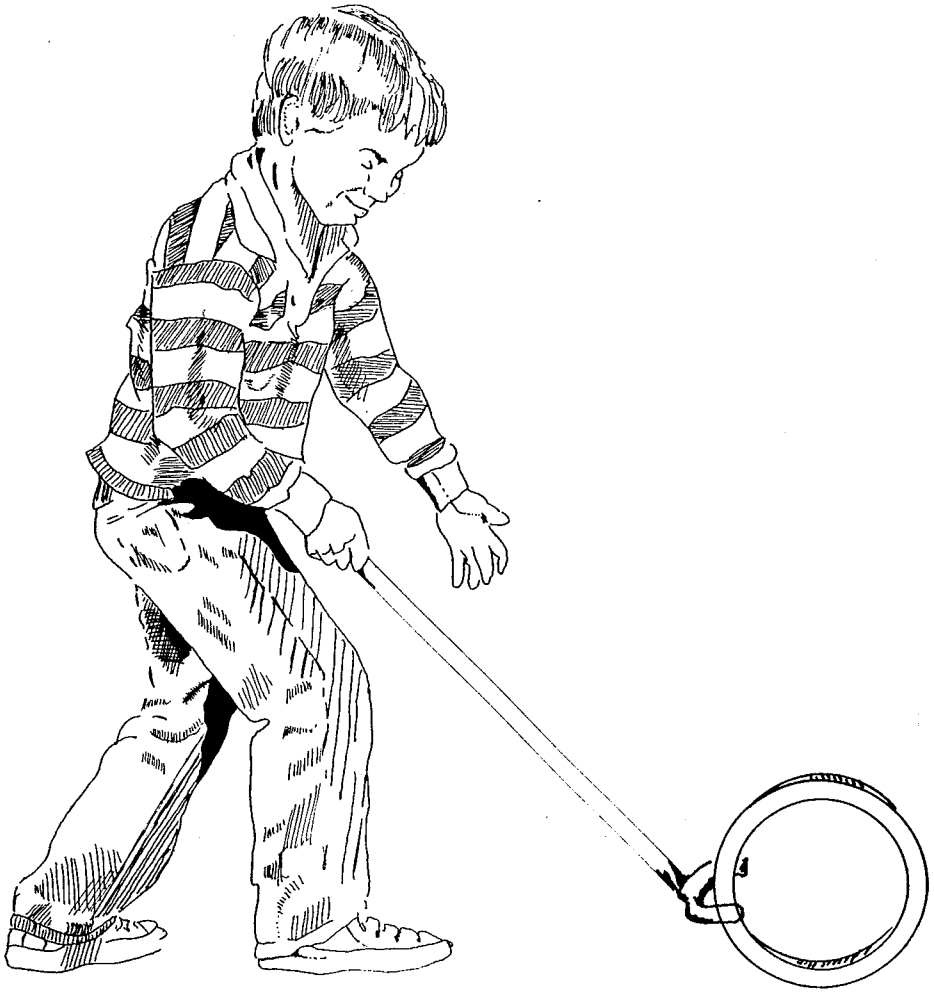

FIG. 3 illustrates a child pushing the hoop with the improved guide stick which needs wrist control only to change movement to the left or to the right which is the advantage of the improved guide stick design. Although U.S. Pat. No. 4,091,564 states at Col. 1, Lines 54–57 that the wheel can be turned abruptly in a right angular direction while in motion at fast speed, up to three miles per hour, it is obvious from the very close fit of the wheel in the yoke that the change of direction must be made by changing direction of the stick itself. The improved guide stick herein disclosed can change direction of the rolling hoop merely by wrist motion to either side by reason of the special shape of the yoke and clearance on the sides of the hoop within the yoke. The hoop can be stopped completely by turning the guide stick upside down to brake down the hoop which then falls over to the ground.

I claim:

1. A toy, comprising in combination, a hoop and a guide stick for rotating and guiding said hoop in any path desired, the hoop being circular in shape and of solid plastic construction, said guide stick comprising a handle and a generally U-shaped yoke, an upper portion of said handle being formed of tubular plastic material with an end cap covering the upper end, an intermediate portion of said handle forming a flat depression on an upper surface thereof for starting the rotating motion of said hoop, the lower portion of said handle being formed of tubular plastic material and the lower end thereof adapted for being connected to said yoke, said yoke comprising a T-shaped tubular section connected to said lower end of said handle and having two opposite ends extending at right angles to said handle, said yoke further comprising a first pair of 45 degree tubular extension sections attached one at each opposite end of the T-shaped section and forming an obtuse angle therewith, said yoke further comprising a second pair of 45 degree tubular extension sections attached to the free end of each of the first extension sections and extending forwardly at an obtuse angle therefrom, said opposite ends of said T-shaped section and said first and second extension sections lying in substantially the same plane and forming a U-shape for engaging the hoop during operation of the toy, said handle extending at approximately a 29 degree angle rearwardly from a line drawn normal to said plane.

2. The toy of claim 1, further including a detachable strip connected between the second pair of extension sections, whereby the hoop may be loosely locked to said yoke section for simplifying the operation of the toy for beginners.

* * * * *